United States Patent [19]

Genereux et al.

[11] Patent Number: 4,574,015

[45] Date of Patent: Mar. 4, 1986

[54] NICKLE BASE SUPERALLOY ARTICLES AND METHOD FOR MAKING

[75] Inventors: Paul D. Genereux, Cromwell; Daniel F. Paulonis, Higganum, both of Conn.

[73] Assignee: United Technologies Corporation, Hartford, Conn.

[21] Appl. No.: 565,490

[22] Filed: Dec. 27, 1983

[51] Int. Cl.[4] ..... C22F 1/10

[52] U.S. Cl. ..... 148/11.5 N; 148/12.7 N; 148/162; 148/409; 148/410

[58] Field of Search ..... 148/11.5 N, 12.7 N, 148/162, 409, 410

[56] References Cited

U.S. PATENT DOCUMENTS

| | | | |
|---|---|---|---|
| 3,620,855 | 11/1971 | Wagner et al. | 148/12.7 N |
| 3,649,379 | 3/1972 | Kotval | 148/12.7 N |
| 3,676,225 | 7/1972 | Owczarski et al. | 148/12.7 N |
| 3,677,830 | 7/1972 | Cox et al. | 148/12.7 N |
| 4,392,894 | 7/1983 | Pearson et al. | 148/12.7 N |

*Primary Examiner*—Stallard W.

*Attorney, Agent, or Firm*—Charles E. Sohl

[57] ABSTRACT

Methods for increasing the forgeability of cast superalloy materials are described. An extremely overaged microstructure is developed by solutionizing the material and slow cooling in the vicinity of the solvus temperature to cause a precipitation of extremely coarse gamma prime material. Subsequently the material can be isothermally forged.

26 Claims, 11 Drawing Figures

2°F/HOUR

500X

5°F/HOUR

500X

10°F/HOUR

500X

200X

200X

200X

200X

NICKLE BASE SUPERALLOY ARTICLES AND METHOD FOR MAKING

DESCRIPTION

1. Technical Field

This invention relates to the forging of gamma prime strengthened nickel base superalloy material, especially in cast form, and, in particular, to a heat treatment which improves the forgeability of such materials.

2. Background Art

Nickel base superalloys are widely used in gas turbine engines. One application is for turbine disks. The property requirements for disk materials have increased with the general progression in engine performance. Early engines used steel and steel derivative alloys for disk materials. These were soon supplanted by the first generation nickel base superalloys such as Waspaloy which were capable of being forged, albeit often with some difficulty.

Nickel base superalloys derive much of their strength from the gamma prime phase. The trend in nickel base superalloy development has been towards increasing the gamma prime volume fraction for increased strength. The Waspaloy alloy used in the early engine disks contains about 25% by volume of the gamma prime phase whereas more recently developed disk alloys contain about 40–70% of this phase. The increase in the volume fraction of gamma prime phase reduces the forgeability of the alloy. Waspaloy material can be forged from cast ingot starting stock but the later developed stronger disk materials cannot be reliably forged and require the use of more expensive powder metallurgy techniques to produce a shaped disk preform which can be economically machined to the final dimensions. One such powder metallurgy process which has met with substantial success for the production of engine disks is that described in U.S. Pat. Nos. 3,519,503 and 4,081,295. This process has proved highly successful with powder metallurgy starting materials but less successful with cast starting materials.

Other patents relating to the forging of disk material include U.S. Pat. Nos. 3,802,938; 3,975,219 and 4,110,131.

In summary, therefore, the trend towards high strength disk materials has resulted in processing difficulties which have been resolved only through recourse to expensive powder metallurgy techniques.

It is an object of the present invention to describe a method through which cast high strength superalloy materials may be readily forged.

It is another object of the present invention to describe a heat treatment method which substantially increases the forgeability of nickel base superalloy materials.

Yet another object of the present invention is to provide a method for forging cast superalloy materials containing in excess of about 40% by volume of the gamma prime phase and which would otherwise be unforgeable.

A further object is to disclose a combined heat treatment and forging process which will produce a fully recrystallized microstructure having a uniform fine grain size and which will substantially reduce forging stresses.

It is yet another object of the invention to provide a highly forgeable nickel base superalloy article having super overaged gamma prime morphology with an average gamma prime size in excess of about 3 microns.

DISCLOSURE OF INVENTION

Nickel base superalloys derive most of their strength from the presence of a distribution of gamma prime particles in the gamma matrix. This phase is based on the compound $Ni_3Al$ where various alloying elements such as Ti and Cb may partially substitute for Al. Refractory elements such as Mo, W, Ta and Cb strengthen the gamma matrix phase and additions of Cr and Co are usually present along with the minor elements such as C, B and Zr.

Table I presents nominal compositions for a variety of superalloys which are used in the hot worked condition. Waspaloy can be conventionally forged from cast stock. The remaining alloys are usually formed from powder, either by direct HIP consolidation or by forging of consolidated powder preforms; forging of cast preforms of these compositions is usually impractical because of the high gamma prime content although Astroloy is sometimes forged without resort to powder techniques.

A composition range which encompasses the alloys of Table I, as well as other alloys which appear to be processable by the present invention, is (in weight percent) 5–25% Co, 8–20% Cr, 1–6% Al, 1–5% Ti, 0–6% Mo, 0–7% W, 0–5% Ta, 0–5% Cb, 0–5% Re, 0–2% Hf, 0–2% V, balance essentially Ni along with the minor elements C, B and Zr in the usual amounts. The sum of the Al and Ti contents will usually range from 4–10% and the sum of Mo+W+Ta+Cb will usually range from 2.5–12%. The invention is broadly applicable to nickel base superalloys having gamma prime contents ranging up to 75% by volume but is particularly useful in connection with alloys which contain more than 40% and preferably more than 50% by volume of the gamma prime phase and are therefore otherwise unforgeable by conventional (nonpowder metallurgical) techniques.

In a cast nickel base superalloy the gamma prime phase occurs in two forms: eutectic and noneutectic. Eutectic gamma prime forms solidification process while noneutectic gamma forms by solid state precipitation during cooling after solidification. Eutectic gamma prime material is found mainly at grain boundaries and has particle sizes which are generally quite large, up to perhaps 100 microns. The noneutectic gamma prime phase which provides most of the strengthening in the alloy, is found within the grains and has a typical size of 0.3–0.5 micron.

TABLE I

| | Waspaloy | Astroloy | RENE 95 | AF 115(2) | RCM 82(3) MERL 76 | IN 100(1) |
|---|---|---|---|---|---|---|
| Co | 13.5 | 17 | 8 | 15 | 18 | 15 |
| Cr | 19.5 | 15 | 13 | 10.7 | 12 | 10 |
| Al | 1.3 | 4 | 3.5 | 3.8 | 5.0 | 4.5 |
| Ti | 3.0 | 3.5 | 2.5 | 3.9 | 4.35 | 4.7 |
| Mo | 4.3 | 5.25 | 3.5 | 3.0 | 3.2 | 3 |
| W | — | — | 3.5 | 6.0 | — | — |
| Cb | — | — | 3.5 | 1.7 | 1.3 | — |
| C | .08 | .06 | .07 | .05 | .025 | .18 |
| B | .006 | .03 | .010 | .02 | .02 | .014 |
| Zr | .06 | — | .05 | .05 | .06 | .06 |
| Ni | Bal | Bal | Bal | Bal | Bal | Bal |
| % $\gamma'$(4) | 25 | 40 | 50 | 55 | 65 | 65 |

(1)Also contains 1.0% V
(2)Also contains .75% Hf
(3)MERL 76 contains .4% Hf
(4)Volume percent The gamma prime phase can be taken into solution by heating the material to an elevated temperature. The temperature at which a phase goes into solution is its solvus temperature. The solutioning (or precipitation) of the gamma prime occurs over a temperature range. In this disclosure, the term solvus start will be used to describe the temperature at which observable solutioning starts (defined as an optical metallographic determination of the temperature at which 5% by volume of the gamma prime phase, present upon slow cooling to room temperature, has been taken into solution) and the term solvus finish refers to the temperature at which solutioning is essentially complete (again determined by optical metallography). Reference to the gamma prime solvus temperature without the adjective low/high will be understood to mean the high solvus temperature.

The eutectic and noneutectic types of gamma prime form in different fashions and have different compositions and solvus temperatures. The noneutectic low and high gamma prime solvus temperatures will typically be on the order of 50°–150° F. less than the eutectic gamma prime solvus temperatures. In the MERL 76 composition the noneutectic gamma prime solvus start temperature is about 2050° F. and the solvus finish temperature is about 2185° F. The eutectic gamma prime solvus start temperature is about 2170° F. and the gamma prime solvus finish temperature is about 2225° F. (since the incipient melting temperature is about 2185° F., the eutectic gamma prime cannot be fully solutioned without partial melting).

Forging is a metal working process in which metal is deformed, usually in compression, at a temperature which is usually above its recrystallization temperature. In most forging processes there are three attributes desired of the process and the product. They are (1) that the finished product have a desirable microstructure, preferably a uniform recrystallized structure, (2) that the product be essentially crack-free, and (3) that the process require a relatively low stress. Naturally the relative importance of these three will vary with the particular situation.

In its broadest form the present invention comprises developing a severely overaged (super overaged) gamma prime morphology in a superalloy material. The mechanical properties of precipitation strengthened materials, such as nickel base superalloys, vary as a function of gamma prime precipitate size. Peak mechanical properties are obtained with gamma prime sizes on the order of 0.1–0.5 microns. Aging under conditions which produce particle sizes in excess of that which provides peak properties produce what are referred to as overaged structures. A super overaged structure is defined as one in which the average noneutectic gamma prime size is at least three times (and preferably at least five times) as large (in diameter) as the gamma prime size which produces peak properties. Because forgeability is the objective, the gamma prime sizes referred to are those which exist at the forging temperature. The provision of such a coarse gamma prime morphology dramatically enhances the forgeability of the material. It also appears that the gamma prime size required for improved forgeability is somewhat related to the fraction of gamma prime present in the material. For lower fraction gamma prime materials a smaller particle size will produce the desired result. For example we believe that a 1 micron gamma prime size will suffice for material having a 40% (by volume) gamma prime content but that a 2.5 micron gamma prime size is needed in material containing 70% (by volume) of the gamma prime phase.

For a constant gamma prime content, as the gamma prime particle size increases the interparticle spacing (the thickness of the intervening gamma matrix phase layer) also increases.

According to a preferred form of the invention the cast starting material is heated to a temperature between the gamma prime start and finish temperatures (or within the solvus range). At this temperature a portion of the noneutectic gamma prime will go into solution.

By using a slow, cooling schedule the noneutectic gamma prime will reprecipitate in a coarse form, with the particle sizes on the order of 5 or even 10 microns. This coarse gamma prime particle size substantially improves the forgeability of the material. The slow cooling step starts at a heat treatment temperature between the two solvus temperatures and finishes at a temperature near and preferably below the noneutectic gamma prime low solvus at a rate of less than 10° F. per hour. This process can also be described as a super overage treatment.

FIG. 2 illustrates the relationship between the cooling rate and the gamma prime particle size for the RCM 82 alloy described in Table I. It can be seen that the slower the cooling the larger the gamma prime particle size. A similar relationship will exist for the other superalloys but with variations in the slope and position of the curve. FIGS. 3A, 3B and 3C illustrate the microstructure of RCM 82 alloy which has been cooled at 2° F., 5° F. and 10° F. per hour from a temperature between the eutectic gamma prime solvus and the noneutectic gamma prime solvus (2200° F.) to a temperature (1900° F.) below the gamma prime solvus start. The difference in gamma prime particle size is apparent. FIG. 4 shows the flow stress for a particular forging operation as a function of the cooling rate for the RCM 82 alloy; reducing the cooling rate from 10° per hour to 2° per hour reduces the required forging flow stress by about 20%. FIG. 5 shows the flow stress versus flow strain for an upset forging operation performed on materials processed according to the present invention and material processed according to the prior art. The conventionally processed material shows a steady state flow stress of about 14.0 ksi and cracks at a strain of about 0.27 (27% reduction in height). Material processed according to the invention shows a steady state flow stress of about 6.5 ksi and no cracking was observed through a reduction of 0.9 (90% reduction in height).

A particular benefit of the invention process is that a uniform fine grain recrystallized microstructure results from a relatively low amount of deformation. In the case of a cylindrical preform upset into a pancake the invention process produces such a microstructure with less than about 50% reduction in height; with conventional processes more than 90% reduction in height is required.

Following the forging step, the forging will usually be heat treated to produce maximum mechanical properties. Such a treatment will include a solution treatment (typically at or above the forging temperature) to at least partially dissolve the gamma prime phase followed by aging at lower temperatures to reprecipitate the dissolved gamma prime phase in a desired (fine) morphology. Those skilled in the art appreciate that variations in these steps permit optimization of various mechanical properties.

Turning now to other aspects of the invention, the starting material is preferably fine grained at least in its surface regions. All cracking encountered during development of the invention process has originated at the surface and is associated with large surface grains.

We have successfully forged material having surface grain sizes in the order of 1/16–⅛" diameter with only minor surface cracking. This was accomplished in a severe forging operation, the upsetting of a cylindrical billet to form a pancake shape. This type of forging places the cylindrical outer surface in a substantial and unrestrained tensile condition. It appears that in other less severe forging applications material having a larger surface grain size (e.g. ¼") could be forged.

We believe that the interior grain size, the grain size more than about one-half inch below the surface of the casting can be substantially coarser than the surface grains. The limiting grain size may well be related to the chemical inhomogeneities and segregation of which occur in extremely coarse grain castings. Equally important is the retention of grain size during the forging process. Processing conditions which lead to substantial grain growth are not desirable since increased grain size is associated with diminished forgeability.

The as cast starting material will usually (and preferably) be given a HIP (hot isostatic pressing) treatment which consists of exposure to a highly pressurized gas at a temperature sufficient for the metal to deform by creep. Typical conditions are 15 ksi applied pressure at a temperature below but within 150° of the gamma prime solvus for a period of time of 4 hours. The result obtained by this treatment is the closure of internal voids and porosity which may be present. The HIP treatment would not be required if a casting technique could be developed which would insure freedom from porosity in the cast product and might not be required if the finished product was to be used in a nondemanding application.

The gamma prime size in the material is then increased as previously described. The material is heated to a temperature at which a substantial quantity (i.e. at least about 40% by volume and preferably at least about 60% by volume) of the noneutectic gamma prime is taken into solution and then slowly cooled to cause a substantial portion of the solutionized noneutectic gamma prime material to reprecipitate as coarse particles. The material will usually be cooled to at least 50° F. below the solvus start temperature and will most usually be cooled to a temperature which approximates the forging temperature.

The cooling rate should be less than about 10° F. and preferably less than about 5° F. per minute. With reference to FIG. 1 any straight line starting at point 0 and falling between 0° F./min and 10° F./min will produce the desired result. It appears however that fluctuating cooling rates may not be satisfactory. See for example line 1 which has a portion A in which the cooling rate excedes 10° F./hr. This would probably be unsatisfactory. We believe that the process will tolerate cooling rates somewhat in excess of 10° F./hr., e.g. 20° F./hr. over short portions of the cooling cycle but this is not preferred. Cooling cycles performed in a furnace with an erratic temperature controller did not produce the desired microstructure even though the overall cooling rate was substantially less than 10° F./hr. Of course, cooling in a furnace with a conventional on/off controller occurs as a series of very small steps but the thermal inertia of the furnace smooths out these fluctuations.

As a further observation, consider curves 2 and 3 which are both curves no part of which has a slope in excess of 10° F./hr. Even though both terminate at point X, preliminary indications are that the results produced by curve 3 (relatively rapid cooling followed by slower cooling) will be preferred to the results from curve 2 (slow cooling followed by faster cooling). The benefits of such a modification would be economic rather than technical in nature.

It is highly desired that the grain size not increase during the previously described gamma prime growth heat treatment. One method for preventing grain growth is to process the material below temperatures where all of the gamma prime phase is taken into solution. By maintaining a small but significant (e.g. 5–30% by volume) amount of the gamma prime phase out of solution grain growth will be retarded. This will normally be achieved by exploiting the differences in solvus temperature between the eutectic and noneutectic gamma prime forms. In certain alloys having relatively high carbon contents the (essentially insoluble) carbide phase will suffice to prevent grain growth. Application of this invention to such alloys will relax the temperature constraints which would need to be observed if retained gamma prime material were relied upon for grain boundary stabilization. A combination of retained gamma prime phase and carbide phase can also be utilized. It is also possible that a certain amount of grain growth may be acceptable especially in forging processes where excessive tensile strains are not encountered and/or in the forging of relatively forgeable alloys.

Retention of sufficient gamma prime material to prevent grain growth can be achieved by using a processing temperature between the eutectic and noneutectic gamma prime solvus temperatures so that retained eutectic gamma prime phase prevents grain growth. We appreciate, however, that it is possible in some alloys to solution heat treat the alloy so as to substantially eliminate the eutectic gamma prime phase by completely solutionizing the eutectic gamma prime followed by reprecipitation. The invention process is still applicable in this event; it is merely necessary to select a processing temperature at which a small but significant amount of the gamma prime phase is retained, an amount sufficient to prevent significant grain growth.

The forging operation will be conducted isothermally (using heated dies) and in a vacuum or inert atmosphere. In this context "isothermal" includes those processes in which minor (i.e. ±50° F.) temperature changes occur during forging. The die temperature will preferably be ±100° F. of the workpiece temperature but any die condition which does not chill the workpiece sufficiently to interfere with the process will be satisfactory. The forging temperature will usually be below but within 200° F. of the noneutectic gamma solvus start temperature, although forging in the lower end of the range between the noneutectic solvus start and finish temperature is also possible.

The forging temperature will usually be near the noneutectic gamma prime low solvus. Forging is conducted at a low strain rate, typically on the order of 0.1–1 in/in/min. The dual strain rate process of U.S. Pat. No. 4,081,295 may be employed. The required forging conditions will vary with alloy, workpiece geometry and forging equipment capabilities and the skilled artisan will be readily able to select the required conditions.

In normal circumstances the invention heat treatment will permit forging of cast nickel base materials to final configuration in a single operation although geometric considerations may dictate the use of multiple forging steps with different shaped dies (without intervening processing being required). One sequence involves use of flat dies to upset a cast preform to a pancake followed by use of shaped dies to achieve a complex final shape.

In unusual circumstances the present invention process might be repeated, i.e. multiple invention heat treatments along with forging operations, but this will not normally be required.

Other features and advantages will be apparent from the specification and claims and from the accompanying drawings which illustrate an embodiment of the invention.

BEST MODE FOR CARRYING OUT THE INVENTION

An alloy having a nominal composition of the RCM 82 alloy in Table I was cast into a cylinder 6" in diameter and 8" high having a grain size of ASTM 2–3 (0.125–0.18 mm avg. dia.). This material contains about 60–65% (by volume) of the gamma prime phase. The noneutectic gamma prime solvus temperature range is about 2050°–2185° F. and the eutectic gamma prime solvus temperature range is about 2150°–2220° F. This casting was produced by Special Metals Corporation, apparently using the teaching of U.S. Pat. No. 4,261,412.

This casting was HIP treated (2165° F., 15 ksi for 3 hours) to close residual porosity (sufficient gamma prime particles are present at 2165° F. to prevent grain growth). The casting was then heat treated at 2165° F. for 2 hours and cooled to 2000° F. at 2° F./hr. (again grain growth did not occur). The resultant noneutectic gamma prime particle size was about 8.5 microns. This material was then forged at 2050° F. at 0.1 in/in/min to a reduction of 76% (producing a 2" high × 12" diameter pancake) without cracking.

In the absence of the invention heat treatment, this amount of reduction would not be achieved without extensive cracking and the required forging forces would be greater than those observed with the invention process. Even where cracking did not occur the structure would be undesirable in that it would only be partially recrystallized.

Figure 6A:
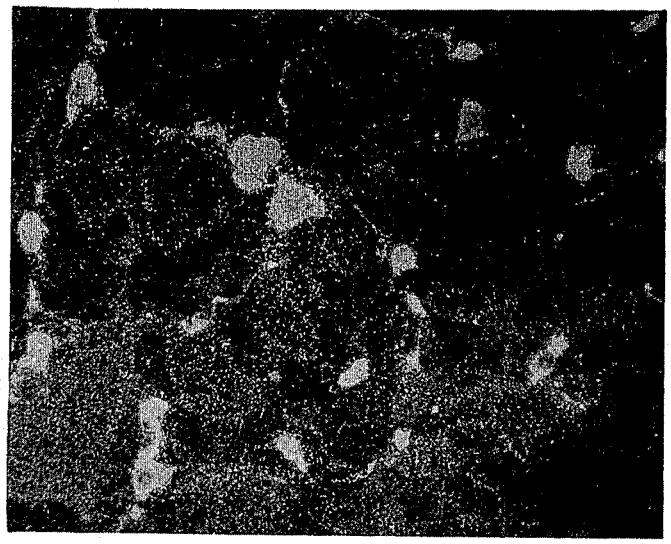
FIGS. 6A and 6B are photomicrographs of conventionally processed material before and after forging.

Certain microstructural features are illustrated in FIGS. 6A, 6B, 7A and 7B. FIG. 6A illustrates the microstructure of cast material. This material has not been given the invention heat treatment. Visible in FIG. 6A are grain boundaries which contain large amounts of eutectic gamma prime material. In the center of the grains can be seen fine gamma prime particles whose size is less than about 0.5 micron.

Figure 6B:
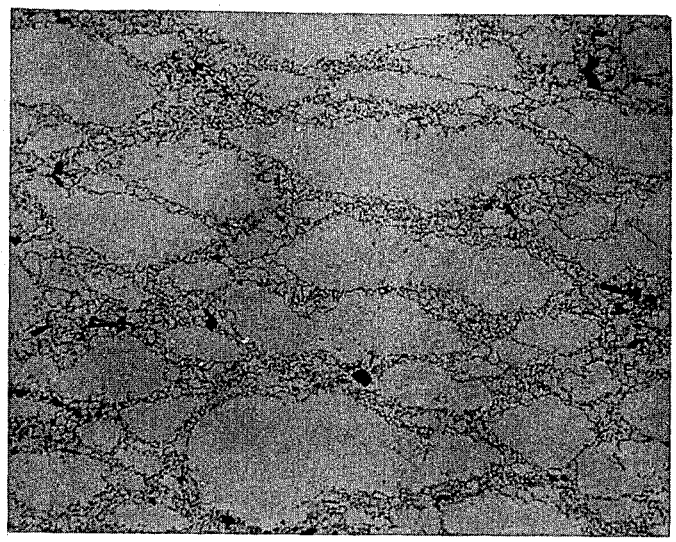

FIG. 6B illustrates the microstructure of the material after conventional forging. Visible in FIG. 6B are fine recrystallized grains at the original grain boundaries which surround material which is essentially nonrecrystallized. This nonuniform (necklace) microstructure is believed not to provide optimum mechanical properties.

Figure 7A:
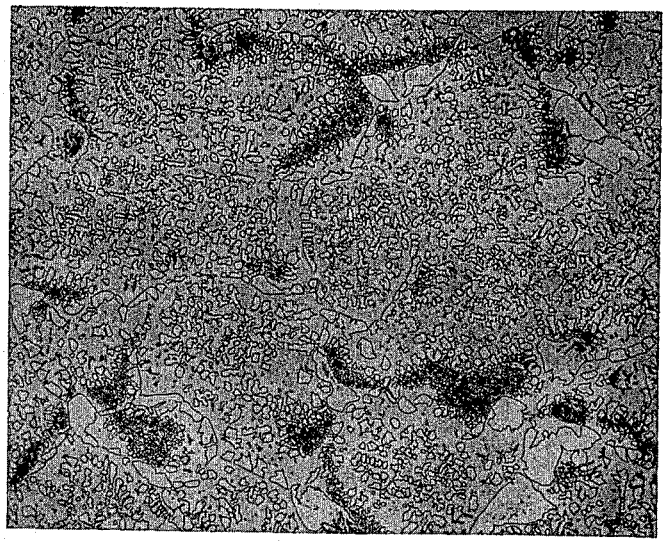
FIGS. 7A and 7B are photomicrographs of invention processed material before and after forging.
Figure 7B:
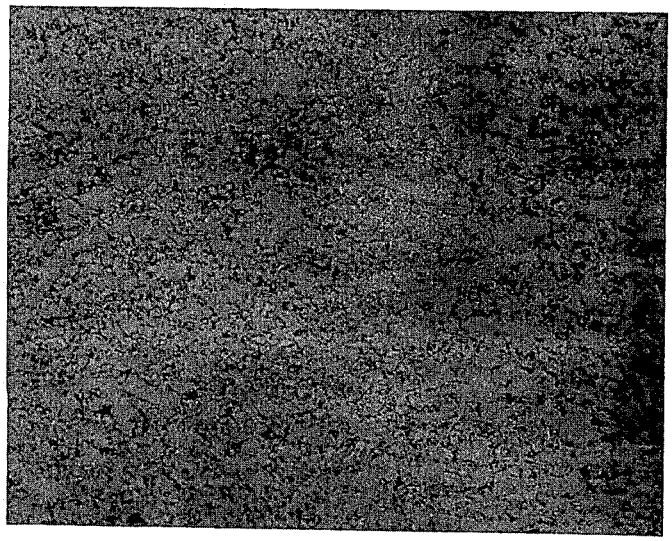

FIG. 7A shows the same alloy composition after the heat treatment of the present invention but prior to forging. The original grain boundaries are seen to contain areas of eutectic gamma prime. Also, significantly, the interior of the grains contain gamma prime particles whose size can be seen to be much larger than the corresponding particles in FIG. 6A. In FIG. 7A the gamma prime particles have a size on the order of 8.5 microns. After forging the microstructure can be seen to be substantially recrystallized and uniform in FIG. 7B. The FIG. 7B material is believed to have superior mechanical properties to the FIG. 6B material.

Figure 1:
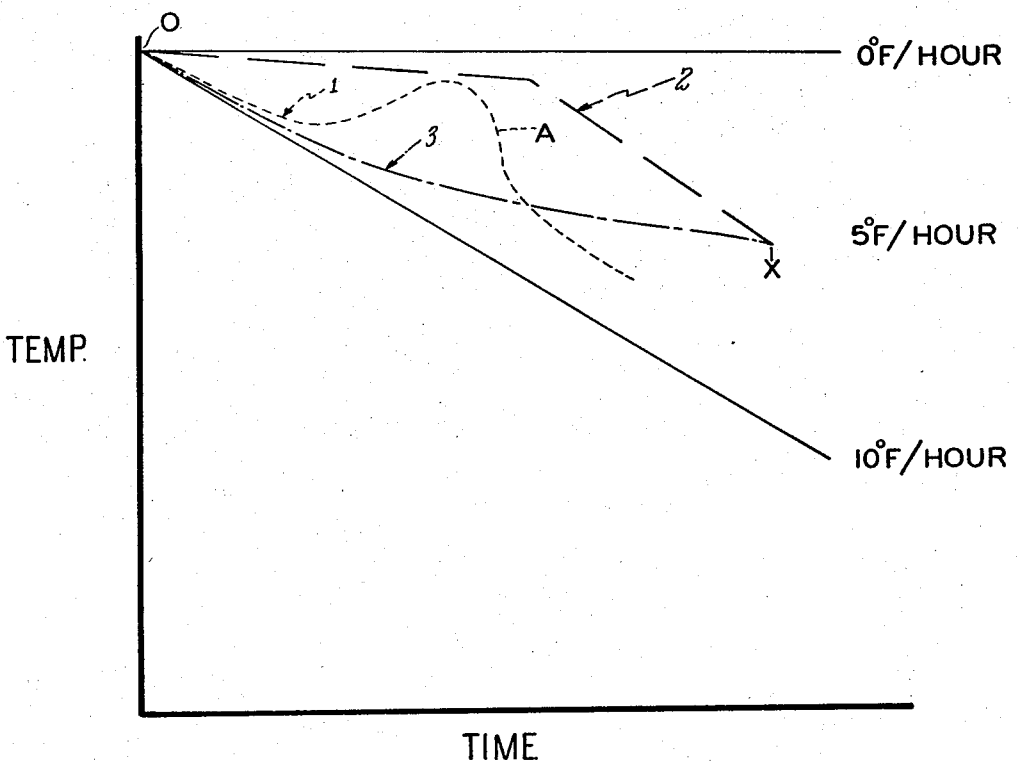
FIG. 1 is a graph illustrating variations in the cooling cycle.
Figure 2:
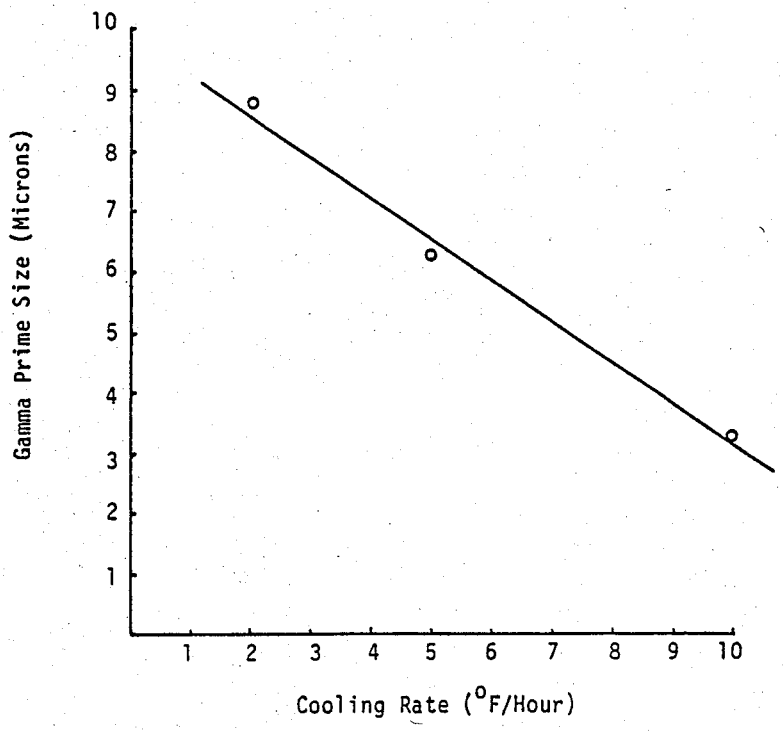
FIG. 2 shows the relationship between cooling rate and gamma prime particle size.
Figure 4:
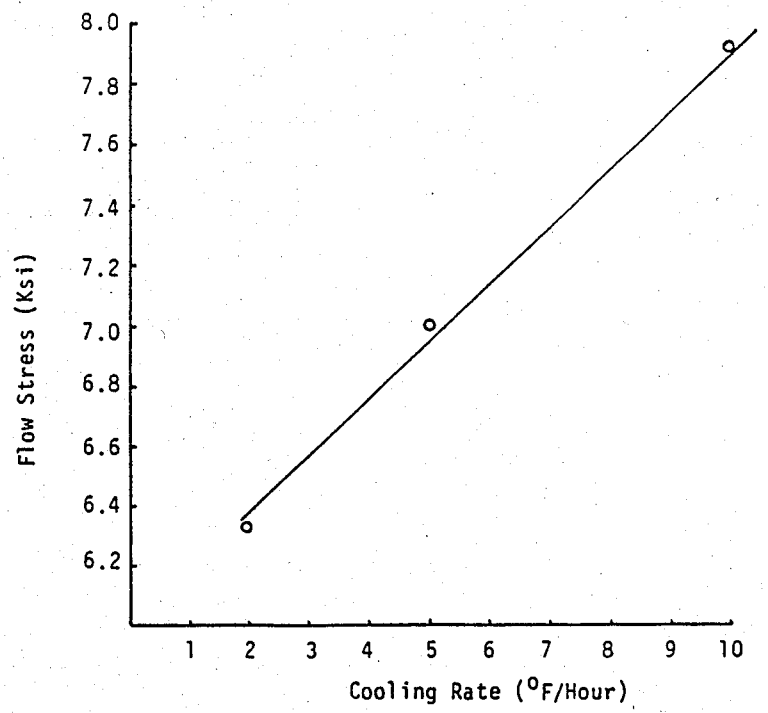
FIG. 4 shows the relationship between cooling rate and forging flow stress.
Figure 3A:
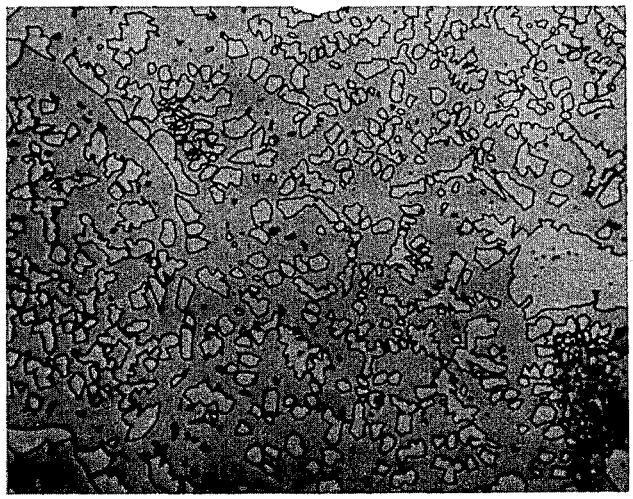
FIGS. 3A, 3B, 3C are photomicrographs of material cooled at different rates.
Figure 3B:
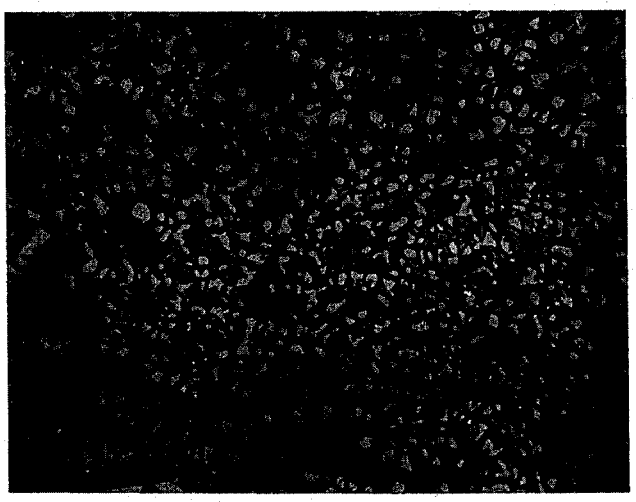
Figure 3C:
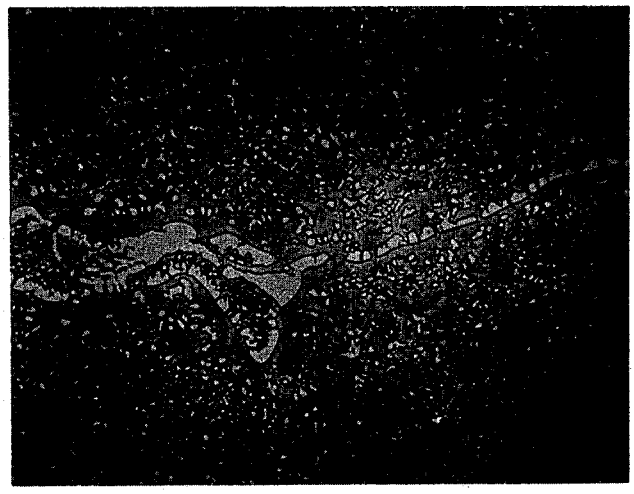
Figure 5:
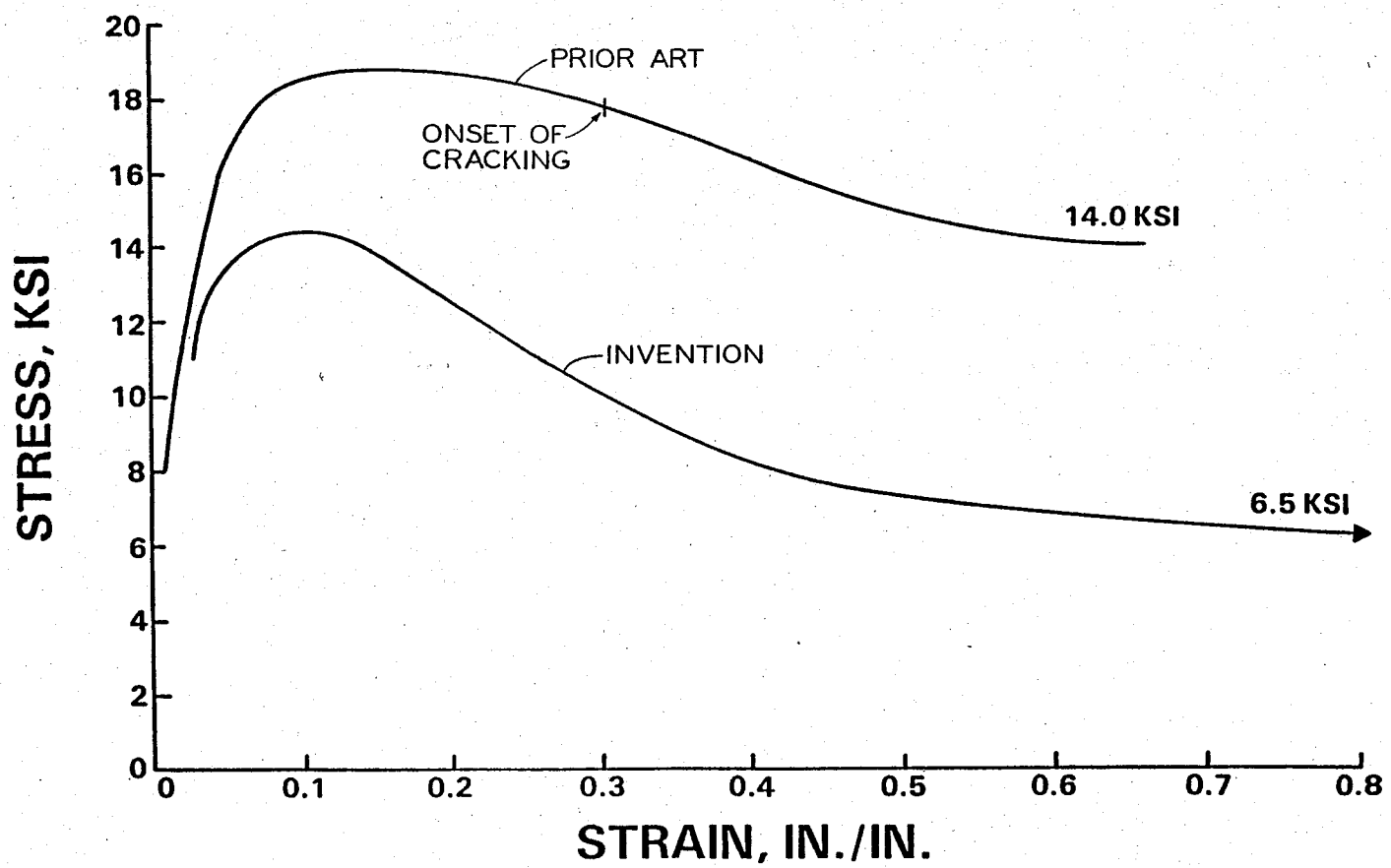
FIG. 5 shows the relationship between stress and strain during forging of conventional and invention processed material.

Thus, in summary, the present invention process achieves the three goals in forging an otherwise unforgeable material without penalty. The reduction at which cracking occurs is dramatically increased (FIG. 5); the final product has an improved microstructure (FIG. 7B); and the flow stress required for forging is substantially reduced (FIG. 4).

It should be understood that the invention is not limited to the particular embodiments shown and described herein, but that various changes and modifications may be made without departing from the spirit and scope of this novel concept as defined by the following claims.

We claim:

1. A method for increasing the forgeability of a nickel base superalloy article which comprises:

heat treating the article so as to solutionize a substantial amount of the gamma prime phase and slow cooling the article to a temperature below the gamma prime solvus start temperature to produce a coarse overaged gamma prime structure.

2. A method as in claim 1 in which the cooling is performed at a rate of less than about 10° F. per hour.

3. A method as in claim 1 in which the cooling is performed at a rate of less than about 5° F. per hour.

4. A method as in claim 1 in which the article is cooled to a temperature at least about 50° F. below the gamma prime start temperature.

5. A method as in claim 1 in which the article is cooled to a temperature at least about 100° F. below the gamma prime start temperature.

6. A method as in claim 1 in which the article is cooled to a temperature which is at least about as low as the intended forging temperature.

7. A method as in claim 1 in which sufficient gamma prime phase material is retained out of solution to prevent significant grain growth.

8. A method as in claim 1 in which at least about 40% by volume of the noneutectic gamma prime phase present at the intended forging temperature is solutionized.

9. A method for increasing the average gamma prime particle size, in a nickel base superalloy, at a forging temperature which comprises:

heat treating the article so as to solutionize a substantial amount of the gamma prime phase and slow cooling the article to a temperature below the gamma prime solvus start temperature to produce a coarse overaged gamma prime structure.

10. A method as in claim 8 in which the cooling is performed at a rate of less than about 10° F. per hour.

11. A method as in claim 8 in which the article is cooled to a temperature at least about 50° F. below the gamma prime start temperature.

12. A method as in claim 8 in which the article is cooled to a temperature which is at least about as low as the intended forging temperature.

13. A method as in claim 8 in which sufficient gamma prime phase material is retained out of solution to prevent significant grain growth.

14. A method as in claim 8 in which at least about 40% by volume of the noneutectic gamma prime phase present at the intended forging temperature is solutionized.

15. A forgeable nickel base superalloy article characterized in that at the forging temperature the average gamma prime particle size is greater than about 2.5 microns.

16. An article as in claim 15 in which the average gamma prime particle size exceeds about 5 microns.

17. A forgeable nickel base superalloy article of the type which exhibits a peak in elevated temperature hot hardness versus gamma prime particle size, at a particular particle size (the peak particle size), said article having an average gamma prime particle size at a typical forging temperature, which is at least 3 times the peak particle size.

18. An article as in claim 17 having an average gamma prime particle size which is at least 5 times the peak particle size.

19. A method for forging a nickel base superalloy article including the steps of a. heat treating the article so as to solutionize a substantial amount of the gamma prime phase and slow cooling the article to a temperature below the gamma prime solvus start temperature to produce a coarse overaged gamma prime structure;

b. isothermally forging the article using heated dies at a temperature below the noneutectic gamma prime solvus start temperature.

20. A method as in claim 19 in which the cooling is performed at a rate of less than about 10° F. per hour.

21. A method as in claim 17 in which the article is cooled to a temperature at least about 50° F. below the gamma prime start temperature.

22. A method as in claim 17 in which the article is cooled to a temperature which is at least about as low as the intended forging temperature.

23. A method as in claim 17 in which sufficient gamma prime phase material is retained out of solution to prevent significant grain growth.

24. A method as in claim 17 in which at least about 40% by volume of the noneutectic gamma prime phase present at the intended forging temperature is solutionized.

25. A method for forging cast nickel base superalloy articles, said alloy containing more than about 40% by volume of the gamma prime phase, including the steps of a. hot isostatic pressing the article to close internal porosity;

b. heat treating the article so as to solutionize at least 40% by volume of the gamma noneutectic prime material present at the forging temperature while retaining sufficient gamma prime material to prevent grain growth, slowly cooling the article at a rate of less than about 10° F. per hour to a temperature which is about equal to the intended forging temperature to produce an overaged gamma prime structure;

c. isothermally forging the article using heated dies at a temperature below the noneutectic gamma prime solvus start temperature.

26. A method as in claim 19 in which the forging temperature is within about 200° F. of the noneutectic gamma prime solvus start temperature and the forging rate is from about 0.05–2 in/in/min.

* * * * *